US008843006B2

(12) United States Patent
Okano

(10) Patent No.: US 8,843,006 B2
(45) Date of Patent: Sep. 23, 2014

(54) IMAGE FORMING APPARATUS AND IMAGE ADJUSTING METHOD

(75) Inventor: Tetsuya Okano, Anjo (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 297 days.

(21) Appl. No.: 13/368,908

(22) Filed: Feb. 8, 2012

(65) Prior Publication Data

US 2012/0251142 A1 Oct. 4, 2012

(30) Foreign Application Priority Data

Mar. 31, 2011 (JP) ..... 2011-079699

(51) Int. Cl.
*G03G 15/00* (2006.01)
*G03G 15/01* (2006.01)

(52) U.S. Cl.
CPC .... *G03G 15/5058* (2013.01); *G03G 2215/0161* (2013.01); *G03G 15/0194* (2013.01)
USPC ..... 399/49

(58) Field of Classification Search
CPC ..... G03G 15/5058; G03G 15/5041; G03G 15/5045
USPC ..... 399/46, 49, 162, 223
See application file for complete search history.

(56) References Cited

U.S. PATENT DOCUMENTS 6,452,147 B1 9/2002 Inada
7,130,551 B2 * 10/2006 Kobayashi ..... 399/49
8,606,130 B2 * 12/2013 Suzuki et al. ..... 399/49
2005/0041990 A1 2/2005 Sugiyama
2006/0024076 A1 * 2/2006 Kato et al. ..... 399/49
2006/0153603 A1 7/2006 Nishikawa et al.
2008/0043299 A1 2/2008 Ikeda
2008/0212986 A1 9/2008 Miyadera
2008/0226313 A1 * 9/2008 Tsuchida et al. ..... 399/44

(Continued)

FOREIGN PATENT DOCUMENTS

JP H10-115962 A 5/1998
JP H11-212329 A 8/1999

(Continued)

OTHER PUBLICATIONS

European Patent Office, Extended European Search Report for European Patent Application No. 12154191.6 (counterpart to above-captioned patent application), mailed Jun. 6, 2013.

*Primary Examiner* — Walter L Lindsay, Jr.
*Assistant Examiner* — Jessica L Eley
(74) *Attorney, Agent, or Firm* — Merchant & Gould PC

(57) ABSTRACT

An image forming apparatus including: an image forming unit that forms an image; a carrier that carries and conveys the image; a detecting unit that detects a first adjustment image based on a light reception result of reflection of light projected toward the carrier; and an adjusting unit that adjusts a formation condition of an image to be formed on a sheet based on a result of the detection of the first adjustment image, wherein the image forming unit forms a second adjustment image having a first mark on the carrier, and wherein when the detecting unit detects the second adjustment image based on a light reception result of reflection of light projected toward the carrier, the adjusting unit adjusts a position of the first adjustment image to be formed on the carrier in the orthogonal direction by using a second orthogonal direction length of the first mark.

16 Claims, 12 Drawing Sheets

(56) References Cited

U.S. PATENT DOCUMENTS

| | | | |
|---|---|---|---|
| 2009/0074476 | A1 | 3/2009 | Miyadera |
| 2009/0190940 | A1 | 7/2009 | Miyadera |
| 2009/0214236 | A1 | 8/2009 | Takane |

FOREIGN PATENT DOCUMENTS

| | | | |
|---|---|---|---|
| JP | 2000-066463 | A | 3/2000 |
| JP | 2001-201896 | A | 7/2001 |
| JP | 2004-347999 | A | 12/2004 |
| JP | 2005-018094 | A | 1/2005 |
| JP | 2006-053305 | A | 2/2006 |
| JP | 2006-195176 | A | 7/2006 |
| JP | 2007-078778 | A | 3/2007 |
| JP | 2007-199120 | A | 8/2007 |
| JP | 2008-077066 | A | 4/2008 |
| JP | 2009-069767 | A | 4/2009 |
| JP | 2009-204859 | A | 9/2009 |
| JP | 2009-205147 | A | 9/2009 |
| JP | 2010-091920 | A | 4/2010 |

* cited by examiner

| |
|---|
| FIG. 4A |
| FIG. 4B |

| FIG. 6A |
| --- |
| FIG. 6B |

IMAGE FORMING APPARATUS AND IMAGE ADJUSTING METHOD

CROSS-REFERENCE TO RELATED APPLICATIONS

This application claims priority from Japanese Patent Application No. 2011-079699 filed on Mar. 31, 2011, the entire contents of which are incorporated herein by reference.

TECHNICAL FIELD

Aspects of the present invention relate to an image forming apparatus, and more particularly, to a technology for performing coarse adjustment to a correction pattern related to image forming

BACKGROUND

As a technology for performing coarse adjustment to a formation position of a correction patch group related to image forming, related art (for example, JP-A-2009-069767) discloses accurately detecting a correction toner image by a first correction mark group for correcting positional misalignment (a second adjustment image). The first correction mark group is configured of marks parallel with a main scanning direction, which is an image read direction in image forming (a direction perpendicular to a conveyance direction of an image formation sheet), and marks inclined with respect to the main scanning direction. In this case, a size of a patch group for correcting positional misalignment of an image (a first adjustment image) is reduced, so as to reduce consumption of a developer. The term "coarse adjustment" means adjusting the formation position of a patch group such that the patch group is formed on a light projection line of a patch detection sensor, prior to adjusting of an image that is performed based on a patch-group detection result of the patch detection sensor.

SUMMARY

In related art, in order to secure a predetermined degree of accuracy of adjustment, a length of the first mark group for positional misalignment correction in a scanning direction is set to be sufficiently longer than a length of the patch group for correcting positional misalignment of an image in the scanning direction. Further, as described above, the first mark group for positional misalignment correction is configured of the marks parallel with the main scanning direction and the marks inclined to the main scanning direction. That is, each correction mark is configured of a horizontal mark portion and an inclined mark portion. Accordingly, it is considered that it is possible to further reduce the consumption of the developer as compared to the above-mentioned technology according to the related art, and it is desired to further reduce the consumption of a toner which is used during an image adjustment operation of the developer.

An object of the present invention is to provide a technology for reducing an amount of a developer which is used for image adjustment without reducing a degree of accuracy of image adjustment.

According to an aspect of the present invention, there is provided an image forming apparatus including: an image forming unit that forms an image using a developer; a carrier that carries and conveys the image formed by the image forming unit; a detecting unit that detects a first adjustment image based on a light reception result of reflection of light projected toward the carrier when the first adjustment image is formed on the carrier by the image forming unit, a length of the first adjustment image in an orthogonal direction, which is a direction orthogonal to a conveyance direction of the image, being a first orthogonal direction length; and an adjusting unit that adjusts a formation condition of an image to be formed on a sheet based on a result of the detection of the first adjustment image by the detecting unit, wherein the image forming unit forms a second adjustment image having a first mark on the carrier, a length of the first mark in the orthogonal direction being a second orthogonal direction length, wherein when the detecting unit detects the second adjustment image based on a light reception result of reflection of light projected toward the carrier, the adjusting unit adjusts a position of the first adjustment image to be formed on the carrier in the orthogonal direction by using the second orthogonal direction length, wherein the second orthogonal direction length of the first mark is smaller than the first orthogonal direction length of the first adjustment image, wherein the first mark is formed at a position on the carrier that is different from a position of the first adjustment image in the conveyance direction, and wherein a first length, which is a length between an intersection of the first mark and a virtual first straight line that extends in the conveyance direction from a first end portion of the first adjustment image in the orthogonal direction and a first end portion of the first mark, which is closer to a virtual second straight line that extends in the conveyance direction from a second end portion of the first adjustment image in the orthogonal direction than a second end portion of the first mark, is smaller than a length obtained by subtracting the second orthogonal direction length from the first orthogonal direction length.

According to another aspect of the present invention, there is provided a method of adjusting an image formed by an image forming unit using a developer by forming a first adjustment image and a second adjustment image for adjusting the image on a carrier that carries and conveys the image, the method including: causing the image forming unit to form the first adjustment image on the carrier such that a length of the first adjustment image in an orthogonal direction, which is a direction orthogonal to a conveyance direction of the image, is a first orthogonal direction length; detecting the first adjustment image based on a light reception result of reflection of light projected toward the carrier when the first adjustment image is formed; adjusting a formation condition of the image to be formed on a sheet based on a result of the detection of the first adjustment image; causing the image forming unit to form the second adjustment image having a first mark on the carrier such that a length of the first mark in the orthogonal direction is a second orthogonal direction length; and detecting the second adjustment image based on a light reception result of reflection of light projected toward the carrier, wherein, the image forming unit is caused to form the second adjustment image having the first mark such that, the second orthogonal direction length of the first mark is smaller than the first orthogonal direction length of the first adjustment image, the first mark is formed at a position on the carrier that is different from a position of the first adjustment image in the conveyance direction, and a first length, which is a length between an intersection of the first mark and a virtual first straight line that extends in the conveyance direction from a first end portion of the first adjustment image in the orthogonal direction and a first end portion of the first mark, which is closer to a virtual second straight line that extends in the conveyance direction from a second end portion of the first adjustment image in the orthogonal direction than a second end portion of the first mark, is smaller than a length obtained by subtracting the second orthogonal direction length from the first orthogonal direction length, and wherein, the formation condition of the image is adjusted such that, if the second adjustment image is detected, a position of the first adjustment image to be formed on the carrier in the orthogonal direction is adjusted by using the second orthogonal direction length.

According to the aspects of the present invention, according to a condition related to the length of the second adjustment image in the direction perpendicular to the image conveyance direction, it is possible to reduce an amount of a developer which is used for image adjustment without reducing a degree of accuracy of image adjustment.

DETAILED DESCRIPTION

<First Exemplary Embodiment>

Hereinafter, a first exemplary embodiment of the present invention will be described with reference to FIGS. 1 to 5.

1. Entire Configuration of Printer

Figure 1:
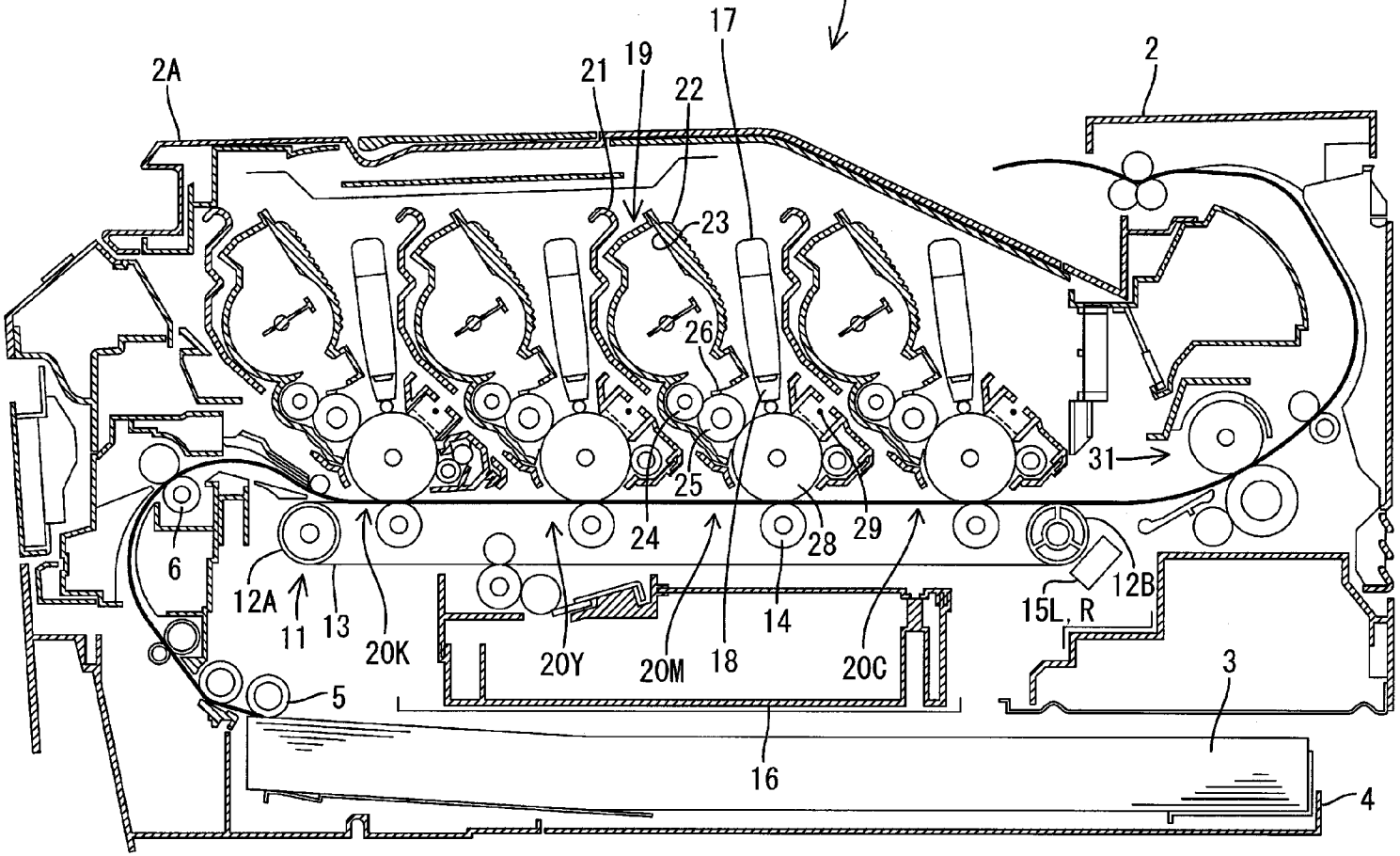
FIG. 1 is a side sectional view illustrating a schematic configuration of an image forming apparatus according to the present invention.

FIG. 1 is a side sectional view schematically illustrating a configuration of a printer 1 which is an example of an image forming apparatus of the present invention. The printer 1 is an LED color printer of a direct tandem type, which forms color images using toners of four colors (black K, yellow Y, magenta M, and cyan C). In the following description, the left side in FIG. 1 is referred to as a front side. In FIG. 1, reference symbols of components, which are common between the colors, are omitted.

The image forming apparatus is not limited to the LED color printer, but may be a laser color printer, a multi-function device having not only a color printer function but also a copy function and a fax function, etc.

The printer 1 includes a main body casing 2, and a cover 2A provided to be openable and closable on the upper face of the main body casing 2. At a lower portion in the main body casing 2, a feed tray 4 is provided such that a plurality of sheets 3 can be loaded. Above a front end of the feed tray 4, sheet feeding rollers 5 are provided. According to the rotation of sheet feeding rollers 5, the uppermost sheet 3 loaded in the feed tray 4 is sent to registration rollers 6. The registration rollers 6 convey the sheet 3 on a belt unit 11 after correcting the skewing of the sheet 3 such.

The belt unit 11 is configured by stretching an annular belt 13 (which is an example of a carrier) between a belt support roller 12A disposed on the front side, and a belt drive roller 12B disposed on the rear side. Inside the belt 13, transfer rollers 14 are provided at positions facing photosensitive drums 28 of processing portions 19C to 19K with the belt interposed therebetween.

When the belt unit 11 is installed in the main body casing 2, the belt drive roller 12B is connected to a drive motor 47 (see FIG. 2) provided in the main body casing 2, through a gear mechanism (not shown). If the belt driving roller 12B is rotated by the power of the drive motor 47, the belt 13 circularly moves clockwise in FIG. 1, such that the sheet 3 on the belt 13 is conveyed toward the rear side.

Also, patch detection sensors 15 (which are examples of a detecting unit) for detecting patch groups 50 (corresponding to a first adjustment image) formed on the belt 13 are provided to face the lower surface of the belt 13. For example, the patch detection sensors 15 include light projection elements each of which is configured of a light emission diode, and light receiving elements each of which is configured of a photo transistor. If light is irradiated onto the belt 13 by the light emission diodes, the reflected light is received by the photo transistors. The patch detection sensors 15 output electric signals corresponding to the intensity of the received light. Below the belt unit 11, a cleaning portion 16 is provided for recovering sheet powder, and toner including the patch groups 50 and mark groups 60 attached to the surface of the belt 13, and the like. The patch detection sensors 15 (L and R) are provided at positions corresponding to both edge portions of the belt 13 in a width direction (see FIG. 3).

Above the belt unit 11, four processing portions and exposing portions corresponding to each processing portions are provided in parallel in a front-rear direction. In the entire printer 1, four image forming units 20C, 20M, 20Y, and 20K are provided to correspond to the colors of cyan, magenta, yellow, and black, respectively. Each of the image forming units 20C to 20K includes one processing portion 19, one exposing portion 17, and one transfer roller 14.

Each exposing portion 17 is supported by a lower surface of the cover 2A and has a LED head 18 at the lower end portions thereof The LED head 18 includes a plurality of LEDs aligned in a line. Light emission of each of the exposing portions 17C to 17K is controlled based on image data which is a target of image formation, and each of the exposing portions 17C to 17K performs exposing by irradiating light from a corresponding LED head 18 onto the surface of a photosensitive drum 28 facing the corresponding LED head 18 for each line, that is, by scanning the photosensitive drum 28 for each line.

Each of the processing portions 19 includes a cartridge frame 21, and a development cartridge 22 installed to be detachable and attachable with respect to the cartridge frame 21. If the cover 2A is opened, the exposing portions 17 withdraw upward together with the cover 2A, such that each processing portion 19 can be individually attached or detached with respect to the main body casing 2.

Each development cartridge 22 includes a toner container 23 for containing a toner of a corresponding color as a developer, and a supplying roller 24, a development roller 25, and a layer-thickness regulating blade 26 provided below the toner container 23, and so on. The toner discharged from the toner container 23 is supplied to the development roller 25 by the rotation of the supplying roller 24, and is triboelectrically and positively charged between the supplying roller 24 and the development roller 25. Further, the toner supplied on the development roller 25 enters a gap between the layer-thickness regulating blade 26 and the development roller 25 by the rotation of the development roller 25, and is triboelectrically charged more sufficiently in the gap, and is carried as a thin layer having a uniform thickness on the development roller 25.

Below the cartridge frames 21, photosensitive drums 28 having surfaces covered with positively charged photosensitive layers, and scorotron type chargers 29 are provided. When an image is formed, the photosensitive drums 28 are rotated, and thus the surfaces of the photosensitive drums 28 are uniformly positively charged by the chargers 29. Then, the positively charged portions are exposed by scanning of the exposing portions 17, such that electrostatic latent images are formed on the surfaces of the photosensitive drums 28.

Next, positively charged toners carried on the development rollers 25 are supplied to the electrostatic latent images on the photosensitive drums 28, such that the electrostatic latent images of the photosensitive drums 28 are visualized. Then, when the sheet 3 passes nip positions between the photosensitive drums 28 and the transfer rollers 14, the toner images carried on the surfaces of the photosensitive drums 28 are sequentially transferred on the sheet 3 by a negative transfer voltage applied to the transfer rollers 14. The sheet having a toner image transferred thereon is conveyed to a fixing portion 31, such that the toner image is fixed by heat. Then, the sheet 3 is conveyed upward, and is discharged to the upper surface of the cover 2A.

2. Electrical Configuration of Printer

Figure 2:
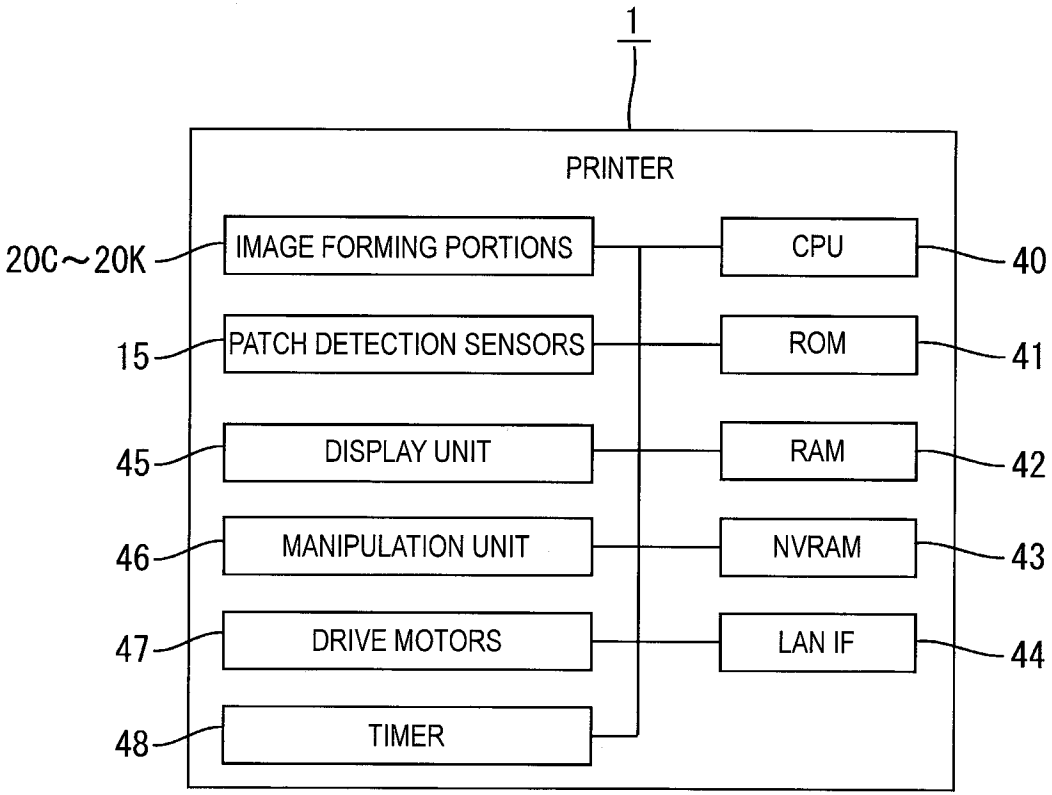
FIG. 2 is a block diagram schematically illustrating an electrical configuration of the image forming apparatus.

FIG. 2 is a block diagram schematically illustrating an electric configuration of the printer 1.

Referring to FIG. 2, the printer 1 includes a Central Processing Unit (CPU) 40 (which is an example of an image forming unit, an adjusting unit, and a detecting unit), a Read Only Memory (ROM) 41, a Random Access Memory (RAM) 42, a Nonvolatile RAM (NVRAM) (a non-volatile memory) 43 and a network interface 44. These components are connected to the image forming units 20C to 20K, the patch detection sensors 15, a display unit 45, a manipulation unit 46, a plurality of drive motors 47, a timer 48, and so on.

The ROM 41 stores programs for performing operations of the printer 1 such as various detection processes (to be described below), and the CPU 40 controls each portions, such as the image forming units 20, related to image forming while storing process results in the RAM 42 or the NVRAM 43 in accordance with the programs read from the ROM 41. The network interface 44 is connected to an external computer (not shown) or the like through a communication line, such that the network interface 44 is capable of data communication with the external computer or the like.

The display unit 45 includes a liquid crystal display, a lamp, and so on, and can display various option screens and the operation state of the printer 1. The manipulation unit 46 includes a plurality of buttons, and enables a user to perform various kinds of input manipulation. The plurality of drive motors 47 rotates the registration rollers 6, the belt drive roller 12B, the development rollers 25, the photosensitive drums 28, and the like, through a gear mechanism (not shown). The timer 48 measures various elapsed times related to image forming 3. Misalignment Correction Process (Two-Stage Correction Process)

Figure 3:
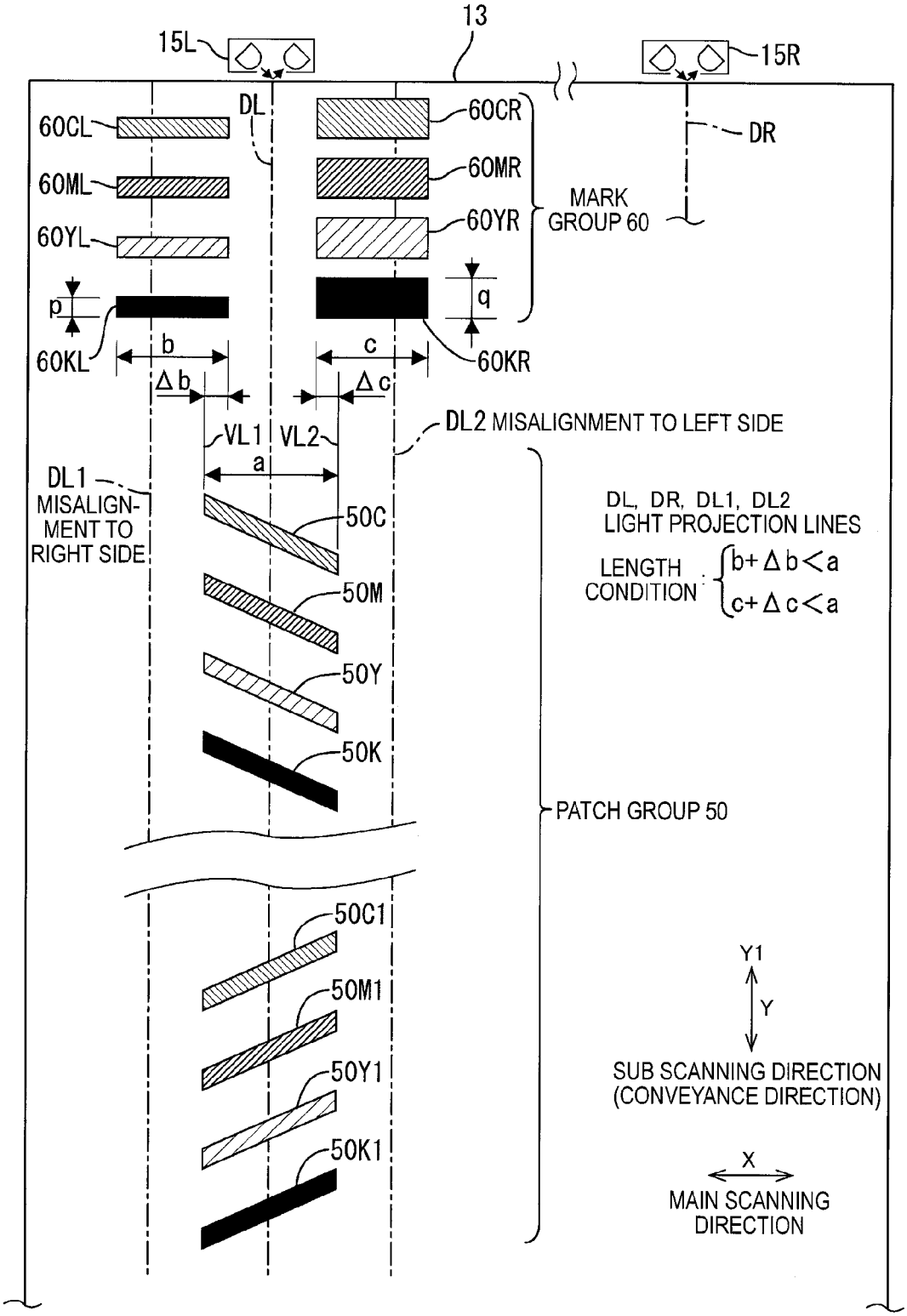
FIG. 3 is a plan view illustrating a patch group and mark groups on a belt.
Figures 4, 4A:
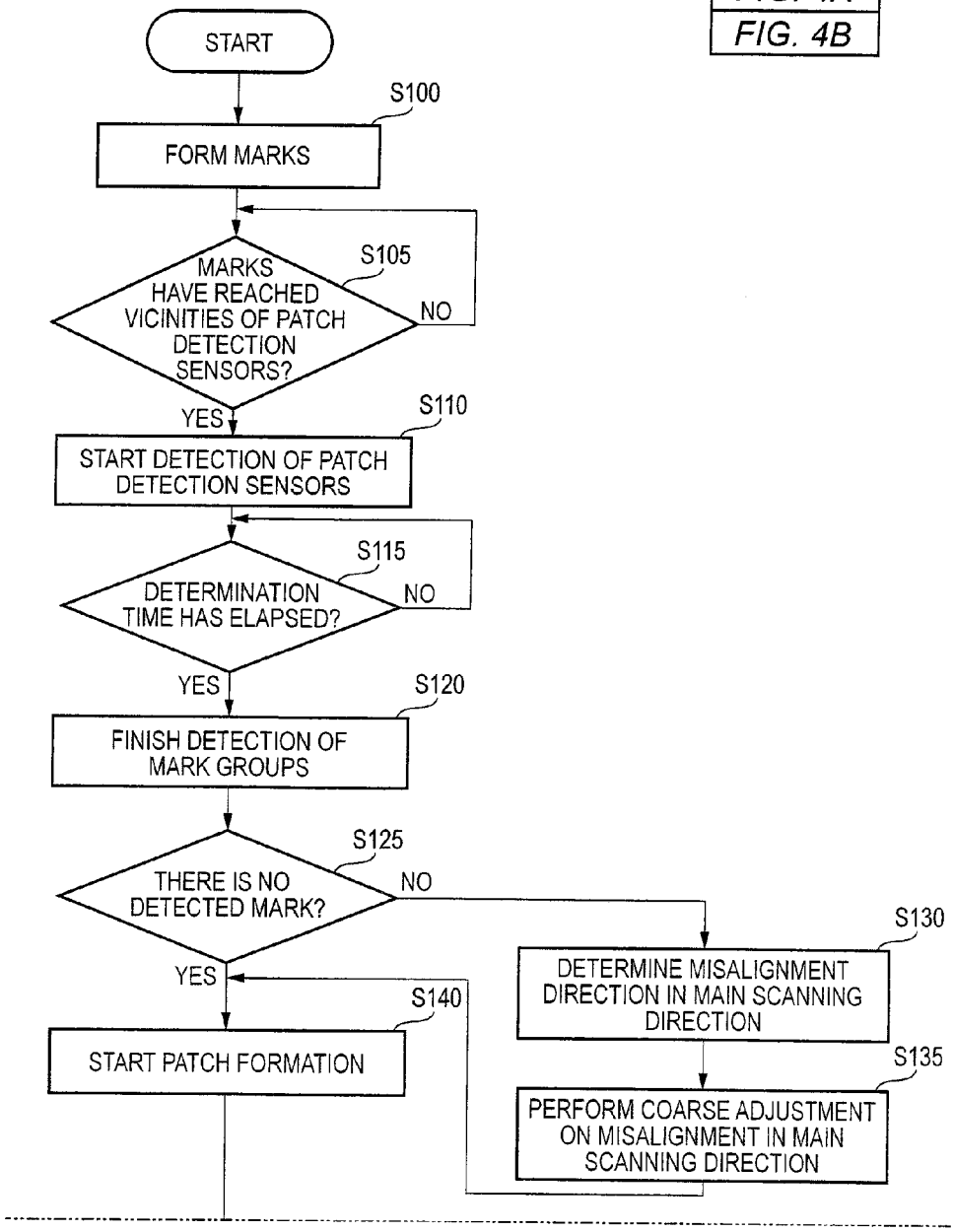
FIG. 4 (4A, 4B) is a flow chart illustrating a misalignment correction process according to a first exemplary embodiment.
Figure 4B:
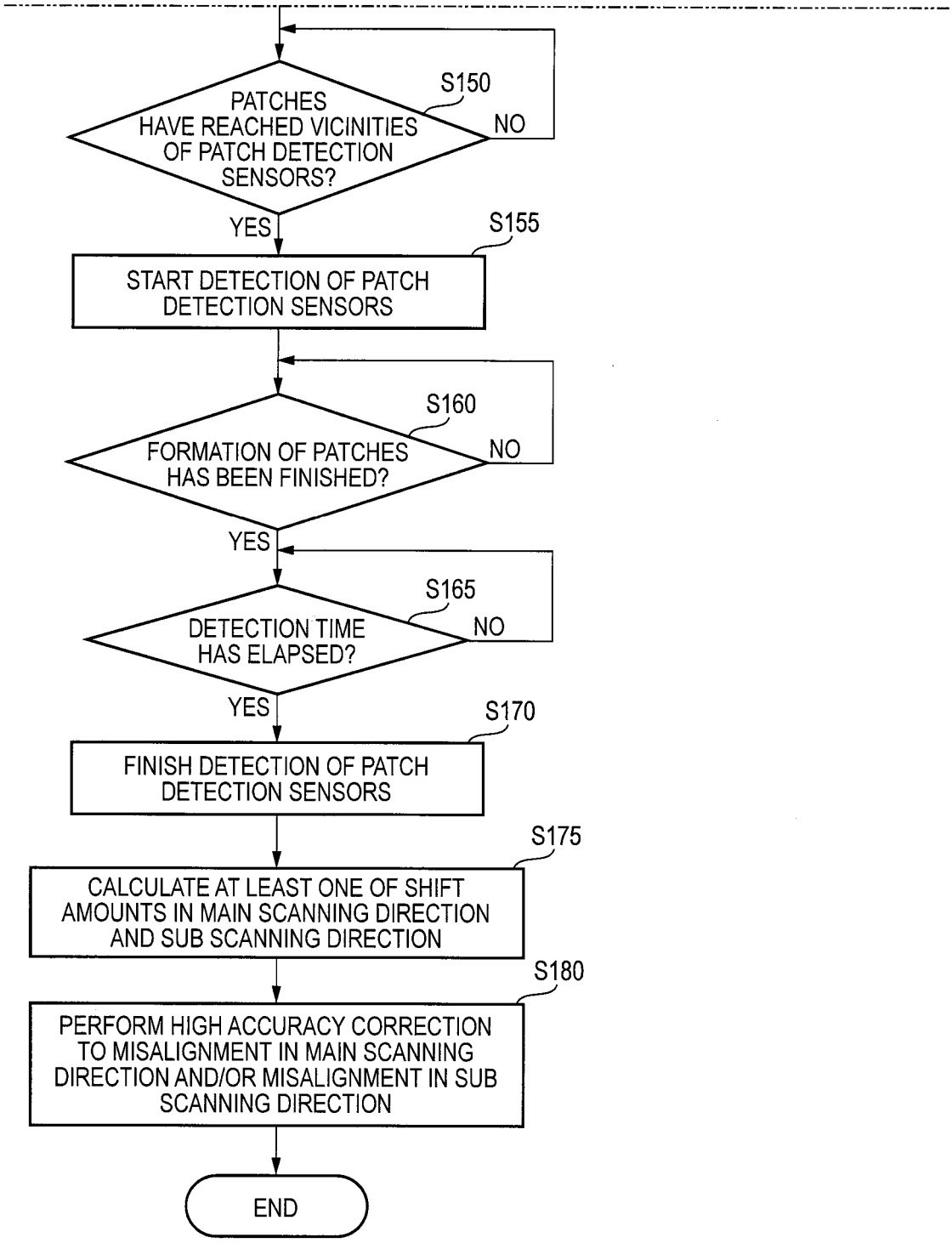
Figure 5:
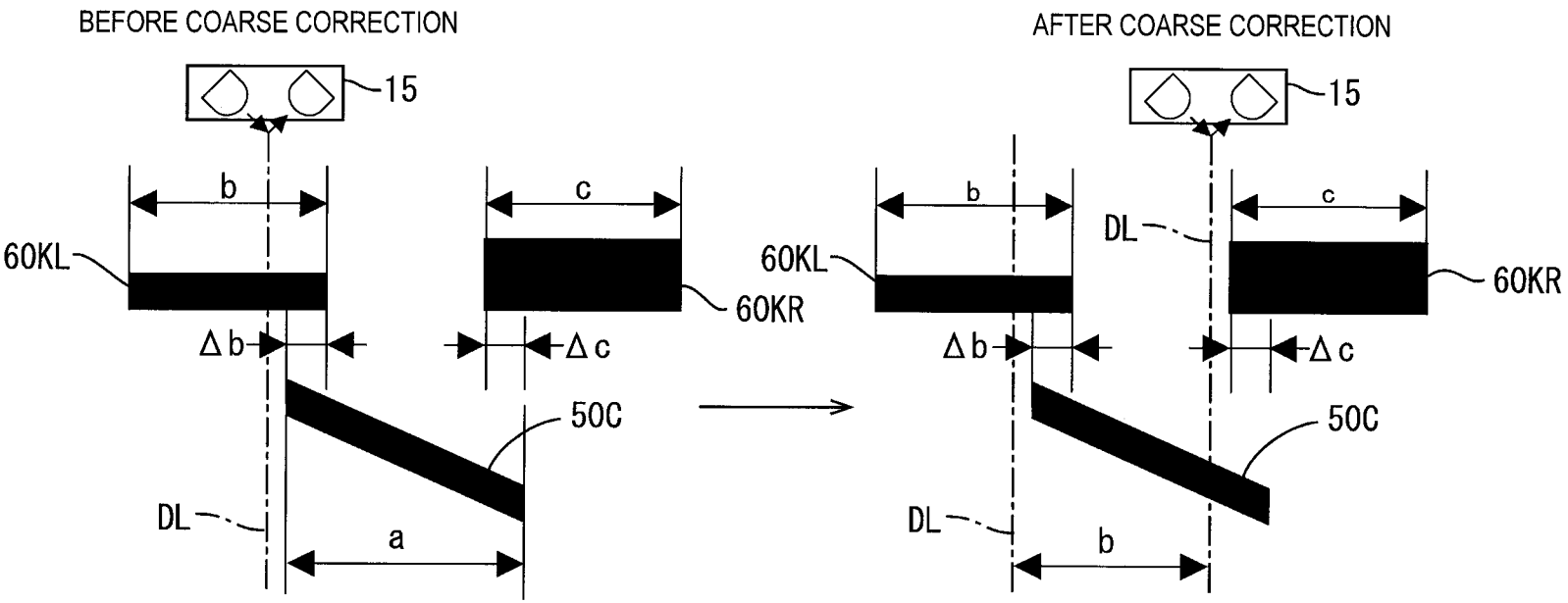
FIG. 5 is a view illustrating misalignment correction according to the first exemplary embodiment.

Next, a misalignment correction process according to the first exemplary embodiment will be described with reference to FIGS. 3 to 5. FIG. 3 is a plan view illustrating a patch group 50 (which is an example of the first adjustment image) and a mark group 60 (which is an example of the second adjustment image) that are formed on the belt 13 in the misalignment correction process. FIG. 4 (4A, 4B) is a flow chart illustrating individual processes of the misalignment correction process of the first exemplary embodiment, and FIG. 5 is a view illustrating coarse correction in the misalignment correction process. In the following description, a term "main scanning direction" means the width direction of the belt 13, and corresponds to a line direction in which scanning is performed by the exposing portions 17 (a direction shown by an arrow X in FIG. 3). Further, a term "conveyance direction" means a direction perpendicular to the main scanning direction, and corresponds to a direction in which the belt 13 moves to convey the toners or the sheet 3 (a direction shown by an arrow Y in FIG. 3). Terms "conveyance direction" and "sub scanning direction" mean the same direction.

The patch groups 50 and the mark groups 60 are both formed on left and right edge portions on the belt 13 in the main scanning direction X. The shape of a patch group 50 and a mark group 60 formed on the left edge portion in the main scanning direction X has the same as that formed on the right edge portion. Therefore, only the patch group 50 and the mark group 60 formed on the left edge portion in the main scanning direction X are shown in FIG. 3.

The misalignment correction process is performed, in accordance with the programs read from the ROM 41, by the control of the CPU 40. For example, the misalignment correction process is performed immediately after the printer 1 is powered on, when predetermined conditions are satisfied, when the opening or closing of the cover 2A is detected, when the attachment or detachment of a processing portion 19 or the belt unit 11 is detected, when a predetermined time period has elapsed from a previous detection process, or when a predetermined number of times of printing is completed.

The misalignment correction process according to the first exemplary embodiment is a two-stage correction process in which formation of the patch groups 50 starts after the mark group 60 is formed and after a detection timing of the mark groups 60 has passed. Accordingly, a distance between the mark group 60 and the patch groups 50 (specifically, a distance between mark 60KL or mark 60KR and patch 50C) shown in FIG. 3 is a distance such that a time period from when the mark group 60 is formed till when the formation of the patch groups 50 starts becomes longer than a time period from when the mark group 60 is formed till when the detection timing of the mark groups 60 has passed.

If the misalignment correction process is started, as shown in FIG. 4, in S100, the CPU 40 controls the image forming units 20C, 20M, 20Y, and 20K, such that the mark group 60 is formed. As shown in FIG. 3, the mark group 60 include four mark pairs (60CL, 60CR), (60ML, 60MR), (60YL, 60YR), and (60KL, 60KR) which correspond to each colors, respectively.

Since the shapes of the mark pairs corresponding to each colors are the same, in the following description, mainly, the mark pair (60KL, 60KR) of black K will be described as a representative. In the mark group 60, a mark group (60CL, 60ML, 60YL, and 60KL) on a left side when viewed toward a downstream side Y1 in the conveyance direction Y is referred to as a left mark group 60L, and a mark group (60CR, 60MR, 60YR, and 60KR) on a right side when viewed toward the downstream side Y1 in the conveyance direction Y is referred to as a right mark group 60R.

The mark 60KL (an example of a first mark) has a rectangular shape which has long sides of a length b and short sides of a length p. Here, the rectangular shape may not be a complete rectangular shape (having equal facing sides and four right angles). In the rectangular shape, that is, the mark 60KL, the length in the main scanning direction X (hereinafter, referred to as a main scanning direction length, which corresponds to a second orthogonal direction length) is b, and the length in the conveyance direction Y (hereinafter, referred to a conveyance direction length) is p. Here, the main scanning direction length corresponds to a length in a direction orthogonal to the conveyance direction Y. The main scanning direction length b is smaller than the main scanning direction length (corresponding to a first orthogonal direction length) a of each of patches SOC, 50M, SOY, and 50K of the patch group 50 (to be described below).

Here, the mark 60KL is formed at a position different from that of the patch 50K of the patch group 50 in the sub scanning direction Y, on the downstream side Y1 in the conveyance direction, by using the toner.

Specifically, the mark 60KL is formed at a position where a length Δb (corresponding to a first length), which is a length between an intersection of the mark 60KL and a virtual first straight line VL1 that extends in the conveyance direction Y from one end portion of the patch 50K of the patch group 50 in the main scanning direction and one end portion of the mark 60KL, which is closer to a virtual second straight line VL2 that extends in the conveyance direction Y from the other end portion of the patch 50K of the patch group 50 in the main scanning direction X than the other end portion of the mark 60KL, is smaller than a length obtained by subtracting the main scanning direction length b of the mark 60KL from the main scanning direction length a of the patch 50K of the patch group 50. That is, the mark 60KL is formed at a position satisfying a condition of $\{\Delta b<(a-b)\}$ or $\{(b+\Delta b)<a\}$.

According to this condition, as shown in FIG. 3, the mark 60KL is formed at a position such that the mark 60KL protrudes from the patch 50K of the patch group 50 by $(b-\Delta b)$ to the left side when viewed toward the downstream side Y1 in the conveyance direction. Therefore, if the mark 60KL is detected, it is detected that the patch formation position is significantly misaligned beyond a predetermined range to the right side when viewed toward the downstream side Y1 in the conveyance direction (the right side in the main scanning direction X). The predetermined range is a misalignment range which can be appropriately adjusted, for example, by high accuracy correction (to be described later).

Meanwhile, the mark 60KR (an example of the second mark) is formed at a position on the opposite side of the mark 60 KL relative to a virtual center line, which is positioned between the first straight line VL 1 and the second straight line VL2. In a case where the patch groups 50 are formed at detection positions by the patch detection sensors 15, as shown in FIG. 3, line DL (hereinafter, referred to as a projected line) on the belt 13 illuminated by light projected from the patch detection sensors 15 coincide with the virtual center line. However, the projected line may not coincide with the virtual center line. The mark 60KR has a rectangular shape which has long sides of a length c and short sides of a length q. In other words, in the mark 60KR, the main scanning direction length (corresponding to a third orthogonal direction length) is c, and the length in the conveyance direction Y is q. Like the main scanning direction length b of the mark 60KL, the main scanning direction length c of the mark 60KR is smaller than the main scanning direction length a of the patch 50K of the patch group 50. Further, the short side length q is larger than the short side length p of the mark 60KL. Meanwhile, the short side length q may be smaller than the short side length p of the mark 60KL. That is, it is only necessary that the short side length p of the left mark group 60L of the mark group 60 is different from the short side length q of the right mark group 60R of the mark group 60.

The mark 60KR is formed at a position where a length Δc (corresponding to a second length), which is a length between an intersection of the mark 60KR and the second straight line VL2 and an end portion of the mark 60KR, which is closer to the first straight line VL1 than another end portion of the mark 60KR, is smaller than a length obtained by subtracting the main scanning direction length c of the mark 60KR from the main scanning direction length a of the patch group 50. That is, the mark 60KR is formed at a position satisfying a condition of $\{\Delta c<(a-c)\}$, that is, $\{(c+\Delta c)<a\}$.

According to this condition, as shown in FIG. 3, the mark 60KR is formed at a position such that the mark 60KL protrudes from the patch 50K of the patch group 50 by $(c-\Delta c)$ to the right side when viewed toward the downstream side Y1 in the conveyance direction. Therefore, if the mark 60KR is detected, it is detected that the patch formation position is significantly misaligned beyond a predetermined range to the left side when viewed toward the downstream side Y1 in the conveyance direction (the left side in the main scanning direction X).

Next, in S105, the CPU 40 determines whether the mark group 60 has reached the vicinities of the patch detection sensors 15. In a case where it is determined that the mark group 60 have reached the vicinities of the patch detection sensors 15 (YES in S105), in S110, the CPU 40 controls the patch detection sensors 15, such that color shift detection starts. Specifically, detection of the mark group 60 is performed.

The detection of whether the mark group 60 has reached the vicinities of the patch detection sensors 15 is performed, for example, based on an elapsed time from the generation of the mark group 60, distances from the generation positions of the mark group 60 on the belt 13 to the patch detection sensors 15, and the movement speed of the belt 13. Further, the detection of the mark group 60 is performed based on the light reception results of the reflection of the light projected from the patch detection sensors 15 to the belt 13. Specifically, based on the reception timings of the reflected light, the detection of the mark group 60 is performed.

Here, the reception timing of each of 8 marks (60CL, 60CR), (60ML, 60MR), (60YL, 60YR), (60KL, 60KR) included in the mark group 60 may correspond to an elapsed time from the generation time of the corresponding mark to the time when the corresponding mark reaches the patch detection sensor 15. Each elapsed time is known in advance based on the distance from the generation position of a corresponding mark on the belt 13 to a corresponding patch detection sensor 15, the movement speed of the belt 13, and so on. The intensity of the reflected light depends on each color. Further, the reception time of the reflected light depends on the conveyance direction length (short side length) of each mark. Therefore, the CPU 40 can individually identify the 8 marks included in the mark group 60 based on different information of the reflected light.

Next, in S115, the CPU 40 determines whether a predetermined detection time has elapsed. Then, if it is determined that the detection time has elapsed (YES in S115), in S120, the CPU 101 finishes the color shift detection, that is, the detection of the mark group 60. The predetermined detection time may be determined in advance to a value obtained by adding $+\alpha$ to the maximum value of the lengths in the sub scan direction which the mark group 60 can take.

Next, in S125, the CPU 40 determines whether there is any mark detected from the mark group 60 during the predetermined detection time. In a case where it is determined that there is no detected mark (YES in S125), in S140, the CPU 40 determines that there is no big difference in forming the patches, and starts forming of the patch groups 50, without performing image adjustment (coarse correction on misalignment).

Meanwhile, in a case where it is determined that there is a detected mark (NO in S125), in S130, the CPU 40 determines a misalignment direction of the patch formation position (formed image) to the projected lines LD in the main scanning direction X, based on the reception of the light (reflected light) from the detected patch. Since each mark of the mark group 60 can be individually identified as described above, the determination on the misalignment direction is performed according to what mark has been detected. Then, in S135, according to the misalignment direction, coarse correction is performed to the patch formation position in the main scanning direction X.

For example, as shown in FIG. 5, in a case where the mark 60KL is detected before the coarse correction, in S130, it is determined that the patch formation position is significantly misaligned to the right side in the main scanning direction, and in S135, coarse correction on the misalignment is performed such that the patch formation position is shifted to the left side in the main scanning direction by a predetermined length b. As shown in FIG. 5, by this coarse correction, an uncorrected patch formation position of the patch group 50 which cannot be detected by the patch detection sensor 15L is adjusted to a position which can be detected the patch detection sensor 15L. In this case, if the mark 60KL is formed according to the above-mentioned condition of $\{\Delta b<(a-b)\}$ or $\{(b+\Delta b)<a\}$, a correction amount can be set to b which is the main scanning direction length of the mark 60KL.

In a case where the mark 60KR is detected, in S130, it is determined that the patch formation position is significantly misaligned to the left side in the main scanning direction, and in S135, the patch formation position is shifted to the right side in the main scanning direction by a predetermined length c.

In other words, in a case where the mark group 60 are detected by the patch detection sensor 15L, the CPU 40 adjusts the position of the patch group 50, which is formed on the belt 13, in the main scanning direction X by using the predetermined length b or c (a second orthogonal direction length or a third orthogonal direction length). Therefore, the adjustment process can be simplified. The processes of S125, S130, and S135 are performed for each color. That is, the coarse correction process is performed for each color.

Next, in S140, based on the misalignment correction result, the CPU 40 starts forming the patch groups 50. In other words, after forming the mark group 60, if a detection timing of the mark group 60 is passed, the CPU 40 starts forming the patch group 50. Then, in S150, the CPU 40 determines whether the patch groups 50 have reaches the vicinities of the patch detection sensors 15, like in S105. In a case where it is determined that the patch groups 50 have reached the vicinities of the patch detection sensors 15 (YES in S150), in S155, the CPU 40 controls the patch detection sensors 15, such that color shift detection starts. Specifically, the detection of the patch groups 50 is performed in the same way as that in the detection of the mark group 60.

Next, in S160, the CPU 40 determines whether the formation of the patch groups 50 has been finished. In a case where it is determined that the formation of the patch groups 50 has been finished (YES in S160), in S165, the CPU 40 determines whether the predetermined detection time has elapsed. In a case where it is determined that the detection time has elapsed (YES in S165), in S170, the CPU 40 finishes the color shift detection, that is, the detection of the patch groups 50. The predetermined detection time may be determined in advance to a value obtained by adding $+\alpha$ to the maximum value of the lengths in the sub scanning direction which the mark group 60 can take.

Next, in S175, the CPU 40 calculates at least one of shift amounts in the main scanning direction X and the sub scanning direction Y of the image to be formed, based on the result of the detection of the patch groups 50, and in S180, the CPU 40 performs high accuracy correction to misalignment in the main scanning direction X and/or misalignment in the sub scanning direction Y, based on the at least one calculated shift amount. In other words, the CPU 40 adjusts the image to be formed on the sheet 3 based on the result of detection of the patch groups 50 having been subject to position adjustment.

The shift-amount calculating process in S175 and the high accuracy correction process in S180 are performed by using methods according to the related art. For example, the shift-amount calculation is performed by calculating shift amounts in the main scanning direction and the sub scanning direction for each of yellow, magenta, and cyan based on black, and the high accuracy correction is performed by adjusting the exposing timings by the exposing portions 17 and the exposed positions of the photosensitive drums 28 based on the calculated shift amounts.

The correction is not limited to positional misalignment correction for each color, but may be density correction for each color. In other words, the coarse correction process in the present exemplary embodiment can be applied not only for performing the positional misalignment correction for each color but also for performing the density correction for each color.

4. Effects of First Exemplary Embodiment

As described above, in the first exemplary embodiment, in a case where the positional misalignment between the belt 13 and the patch groups 50 is significant and the mark group 60 is detected, the positional misalignment can be corrected simply by adjusting the positions of the patch groups 50 in the width direction (orthogonal direction which is the main scanning direction X) by b or c based on the condition ($\{(b+\Delta b)<a\}$ or $\{(c+\Delta c)<a\}$) related to the main scanning direction length of each mark of the mark group 60 relative to a corresponding patch group 50.

Further, although the patch groups 50 require a general size for securing image adjustment accuracy, the short length p or q of each mark of the mark group 60 (first and second marks) can be set to be short as possible as long as the mark can be detected by a corresponding patch detection sensor 15. Furthermore, marks for each color are configured of a pair of rectangular marks separated from each other in the main scanning direction X. Therefore, it is possible to reduce the length in the main scanning direction X (the length of the horizontal mark portion) as compared to a case where a mark is configured of a horizontal mark portion and an inclined mark portion according to the related art, and it is possible to omit marks (the inclined mark portions) inclined to the main scanning direction X. Accordingly, it is possible to reduce the total area of the mark group 60, as compared to the total area of the mark group according to the related art, and to reduce the amounts of toners (developers) for forming the mark group 60. In other words, it is possible to reduce the consumption of developers for image adjustment without reducing the image adjustment accuracy.

After the formation of the mark group 60, if the detection timing of the mark group 60 has passed, the formation of the patch groups 50 starts. In this case, if the mark group 60 is not detected, the positional misalignment of the patch groups 50 is considered as insignificant, and thus is considered as allowable. Therefore, it is not required to correct the positional misalignment of the patch groups 50, that is, it is not required to form the patch groups 50 again. Therefore, it is possible to reduce the consumption of toners, as compared to a case of starting the formation of the patch groups 50 prior to the detection timing of the mark group 60.

The short side length p (first conveyance direction length) of the left mark group 60L (first mark) of the mark group 60 is different from the short side length q (second conveyance direction length) of the right mark group 60R (second mark) of the mark group 60. Further, the left mark group 60L is formed on the left side of the right mark group 60R in the main scanning direction (orthogonal direction) X when viewed toward the downstream side Y1 in the conveyance direction. Therefore, it is possible to easily and appropriately determine whether misalignment has occurred on the left side or the right side in the main scanning direction X based on the difference between the detection duration time of the reflected light from the left and right mark group 60L and 60R.

<Second Exemplary Embodiment>

Figures 6, 6A:
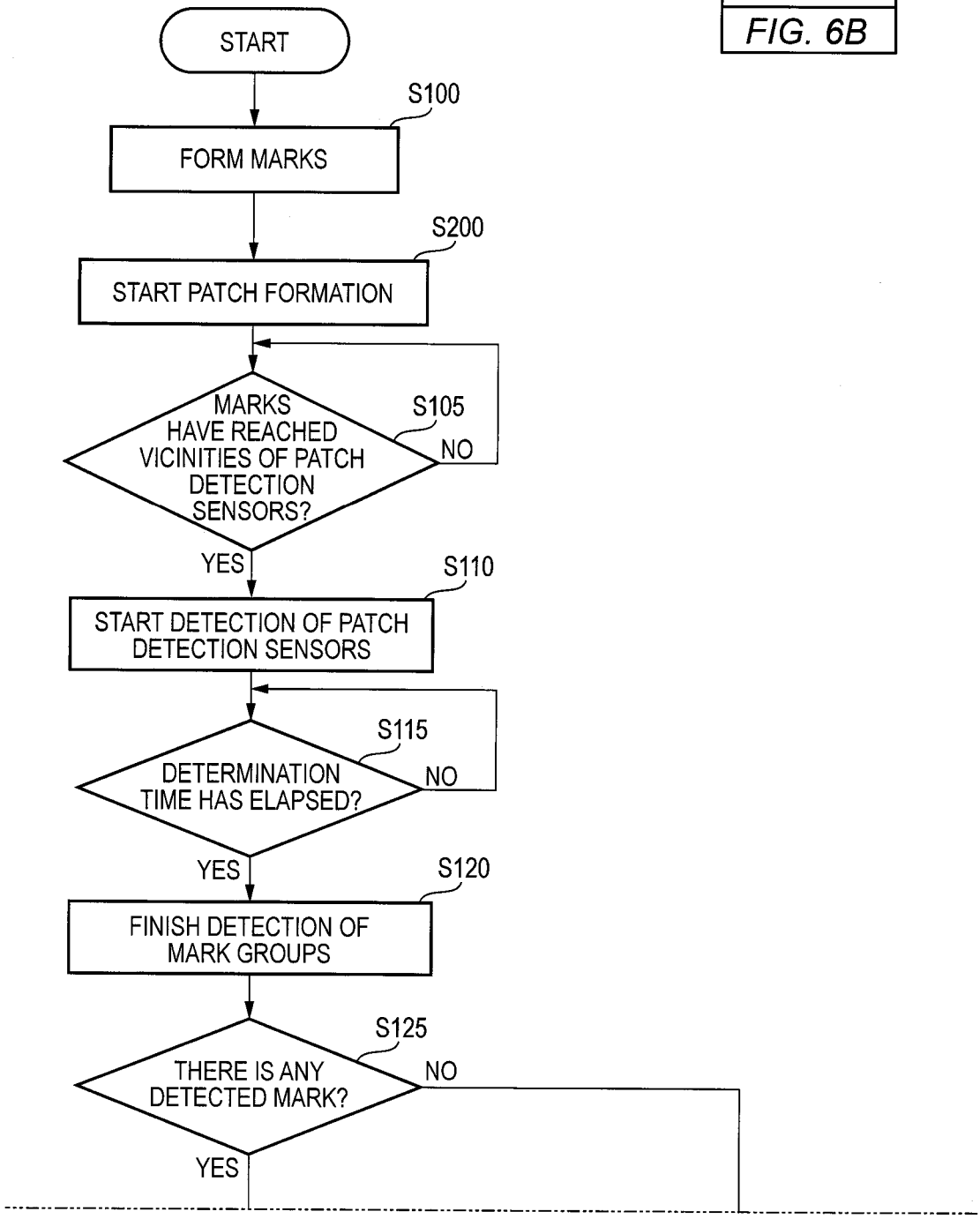
FIG. 6 (6A, 6B) is a flow chart illustrating a misalignment correction process according to a second exemplary embodiment.
Figure 6B:
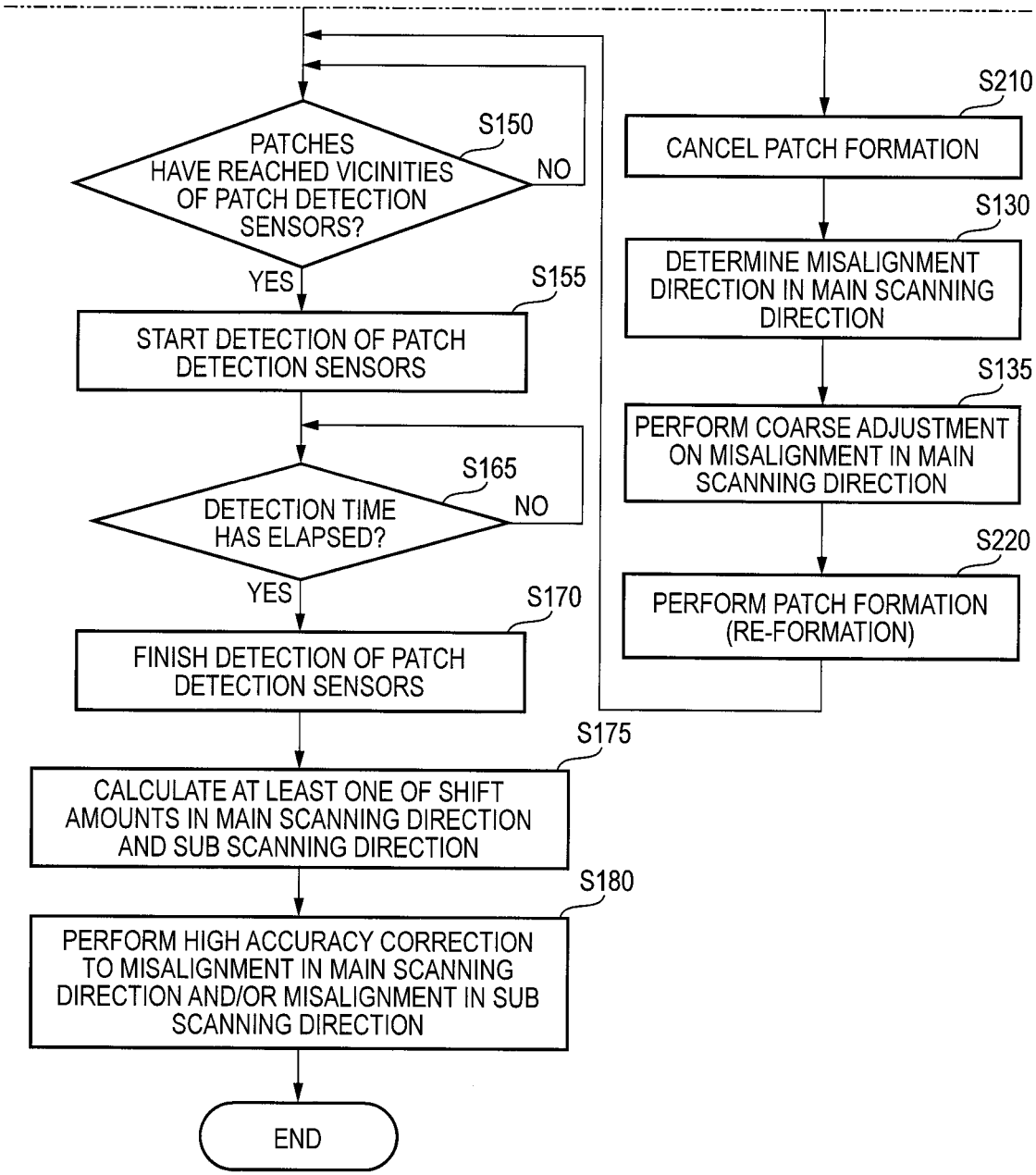

Next, a second exemplary embodiment of the present invention will be described with reference to FIG. 6. FIGS. 6 (6A, 6B) is a flow chart illustrating a misalignment correction process according to the second exemplary embodiment. The second exemplary embodiment is different from the first exemplary embodiment only in the misalignment correction process, and thus only the difference from the first exemplary embodiment will be described below. Further, identical processes of the second exemplary embodiment to those of the first exemplary embodiment are denoted by the same reference symbols, and the redundant description will not be repeated.

In the misalignment correction process of the first exemplary embodiment, the two-stage correction process, in which the formation of the patch groups 50 starts after the detection timing of the mark group 60 has passed, is performed. In contrast, in the misalignment correction process of the second exemplary embodiment, a batch correction process, in which the formation of the patch groups 50 starts from before the detection timing of the mark group 60, is performed. Accordingly, a distance between the mark group 60 and the patch groups 50 (specifically, a distance between the mark 60KL or the mark 60KR and the patch 50C) shown in FIG. 3 is a distance such that a time period from when the mark group 60 is formed till when the formation of the patch groups 50 starts becomes shorter than a time period from when the mark group 60 is formed till when the detection timing of the mark groups 60 has passed.

That is, as shown in FIG. 6, the CPU 40 controls the image forming units 20C, 20M, 20Y, and 20K to start the formation of the patch groups 50 (S200) subsequently after the mark group 60 is formed (S100).

Then, in a case where it is determined in S125 that there is a mark detected from the mark group 60 (NO in S125), in S210, the CPU 40 stops the formation of the patch groups 50. Then, the CPU 40 performs the misalignment-direction determining process (S130) and the coarse correction process on the main scanning direction (S135) according to the color of the mark determined in S125. Subsequently, in S220, the CPU 40 starts the canceled formation of the patch groups 50 from the beginning. Then, the CPU 40 performs the same subsequent processes as those of the first exemplary embodiment.

5. Effects of Second Exemplary Embodiment

In the batch correction process of the second exemplary embodiment, in a case where there is no mark detected from the mark group 60, since coarse adjustment on the patch groups 50 is not required, the formation of the patch groups 50 is not canceled. Therefore, in a case where the patch formation position is not significantly misaligned, it is possible to reduce the total adjustment time, as compared to the two-stage correction process of the first exemplary embodiment.

<Other Exemplary Embodiments>

The present invention is not limited to the exemplary embodiments described with reference to the drawings. For example, the following exemplary embodiments can be included in the technical scope of the present invention.

Figure 7:
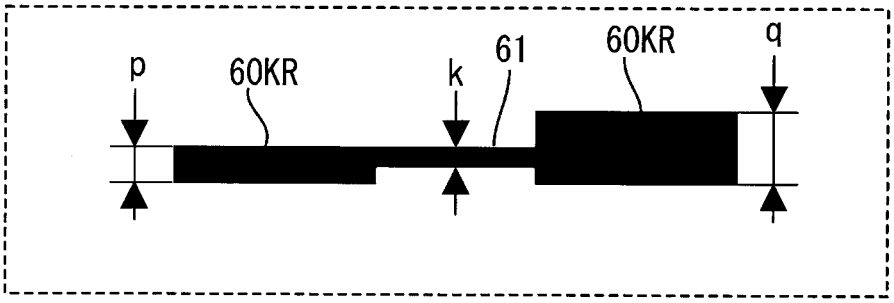
FIG. 7 is a view illustrating a shape of another mark group.

(1) In each of the above-mentioned exemplary embodiments, an example in which the mark group 60 is configured of the left mark group 60L and the right mark group 60R separated from each other has been described. However, the present invention is not limited thereto. As shown in FIG. 7, a left mark 60KL and a right mark 60KR may be connected to each other by a connection portion 61 having a short side length k (third conveyance direction length) which is different from the short side length p (first conveyance direction length) and the short side length q (second conveyance direction length). In this case, the connection portion 61 can be detected from the difference between the detection duration times of the reflected light. Therefore, it is possible to accurately determine that the degree of misalignment is low, based on the detection of the connection portion 61, and to accurately determine that the coarse correction is not required.

Figure 8:
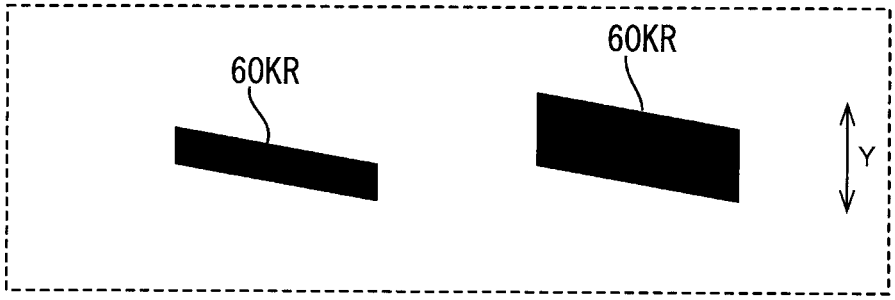
FIG. 8 is a view illustrating a shape of another mark group.
Figure 9:
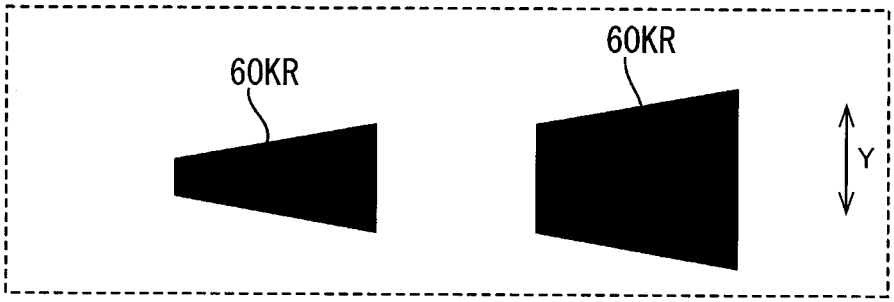
FIG. 9 is a view illustrating a shape of another mark group.

(2) In each of the above-mentioned exemplary embodiments, an example where each mark of the mark group 60 has a rectangular shape has been described. However, the present invention is not limited thereto. For example, the shape of each mark may be a rectangular shape inclined in the conveyance direction Y by a predetermined angle, as shown in FIG. 8, or may be a trapezoidal shape as shown in FIG. 9. Alternatively, the shapes of left and right marks for each mark may be the inversion of each other.

That is, the first mark (the left mark or the right mark) may have the first conveyance direction length which is a constant length in the conveyance direction Y, and the second mark (the right mark or the left mark) may have a constant length in the conveyance direction Y which is the second conveyance direction length different from the first conveyance direction length. In this case, it is possible to easily and appropriately determine which of misalignment on the left side and misalignment on the right side in the main scanning direction X is greater, from the difference between the detection duration times of the patch detection sensors 15 on the first mark and the second mark.

Figure 10:
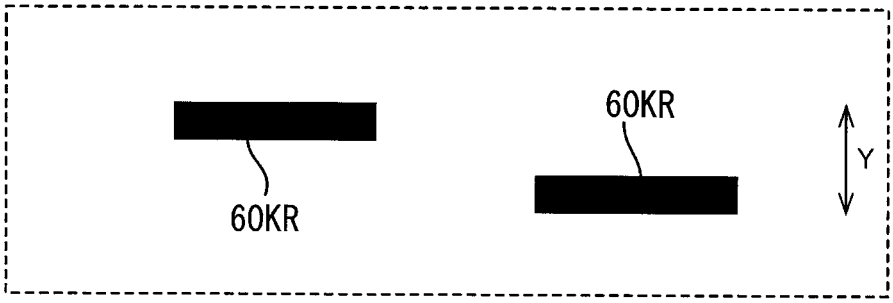
FIG. 10 is a view illustrating a shape of another mark group.
Figure 11:
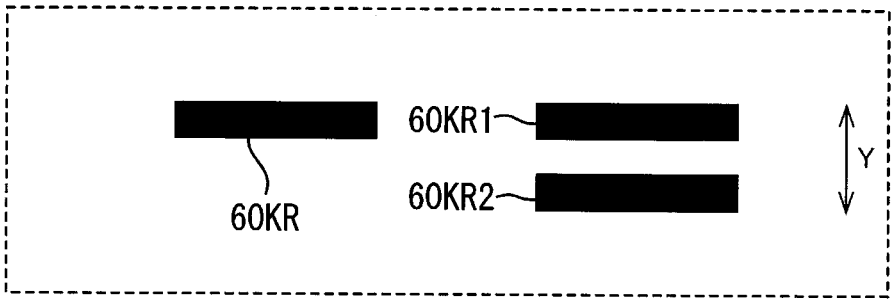
FIG. 11 is a view illustrating a shape of another mark group.

(3) In each of the above-mentioned exemplary embodiments, an example in which the first mark (the left mark or the right mark) and the second mark (the right mark or the left mark) are formed such that the first mark and the second mark are different from each other in the conveyance direction length (short side length) has been described. However, the present invention is not limited thereto. As shown in FIGS. 10 and 11, the first mark and the second mark may be formed so as to have the same short side length.

In this case, since it is possible to minimize the conveyance direction length of each mark, it is possible to reduce the consumption of toners for forming the marks 60, as compared to a case where the marks are different in the short side length.

In this case, preferably, as shown in FIG. 10, the left mark 60KL and the right mark 60KR are formed to be different from each other in the formation position in the conveyance direction Y. Therefore, even if the first mark and the second mark have the same shape, since the detection timings (detection times) of the marks are different, it is possible to appropriately distinguish misalignment on the left side and misalignment on the right side from each other. Also, preferably, as shown in FIG. 11, each of the first mark and the second mark is configured of at least one mark, and a number of the marks configuring the first mark 60KL and a number of marks configuring the second mark 60KR1 and 60KR2 are different. Therefore, even if the first mark and the second mark have the same shape, since the number of times of mark detection within a predetermined detection period differs, it is possible to appropriately distinguish misalignment on the left side and misalignment on the right side from each other.

Figure 12:
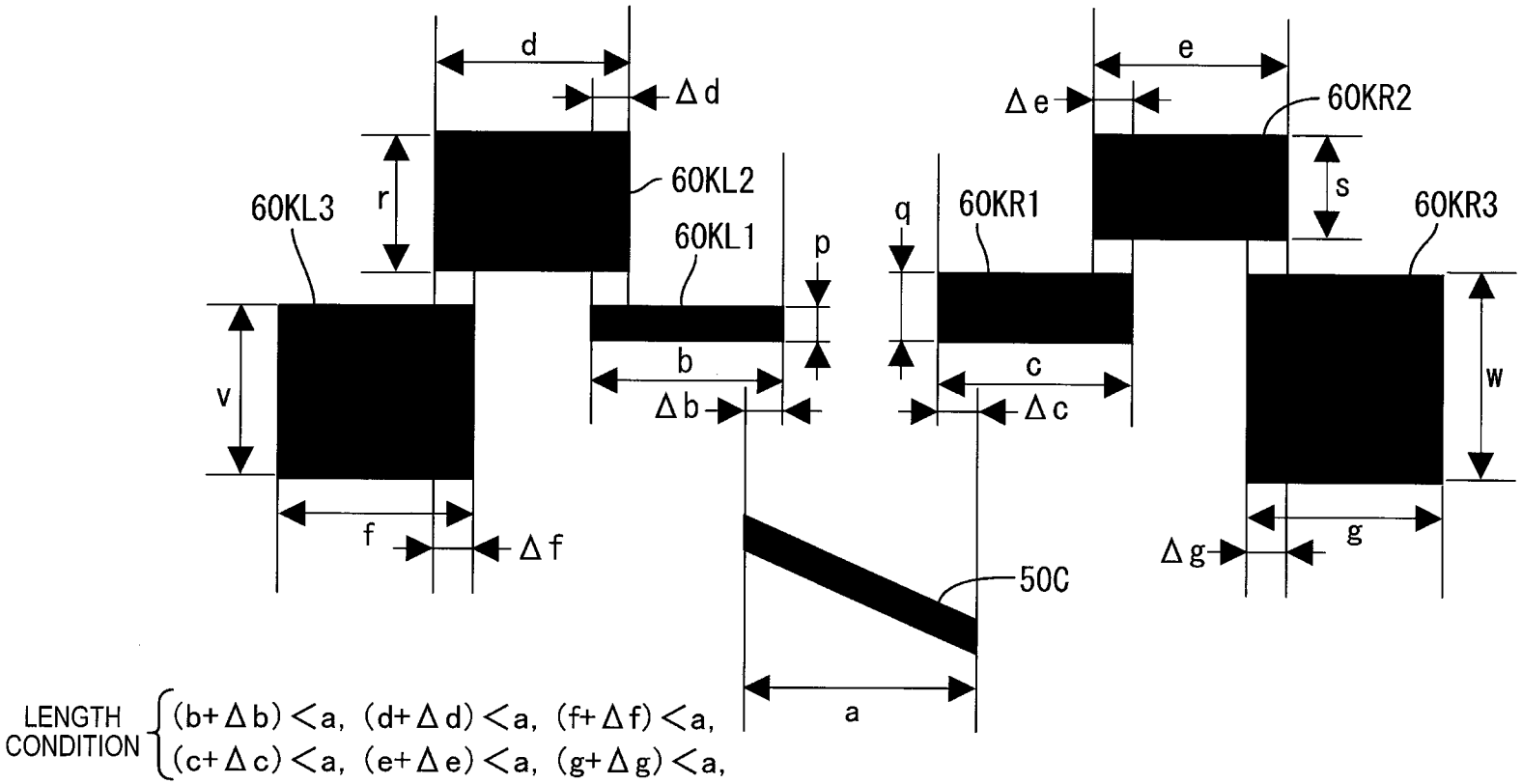
FIG. 12 is a view illustrating a shape of another mark group.

(4) In each of the above-mentioned exemplary embodiments, an example in which each of the left mark and the right mark for each color is configured of one mark has been described. However, the present invention is not limited thereto. As shown in FIG. 12, each of the left mark and the right mark for each color may be configured of a mark group including a plurality of marks. For example, as shown in FIG. 12, each marks of the left and right mark group are formed at different positions in the width direction (orthogonal direction which is the main scanning direction X) on the belt 13, such that the marks have rectangular shapes having lengths (main scanning direction lengths) b, d, f, c, e, and g smaller than the length a (first orthogonal direction length) of the patch group 50, and different conveyance direction lengths (lengths in the sub scanning direction) p, r, v, q, s, and w, and the lengths of the overlaps of the marks are Δd, Δf, Δe, and Δg. In this case, it is possible to appropriately widen the adjustment range of the coarse adjustment.

Figure 13:
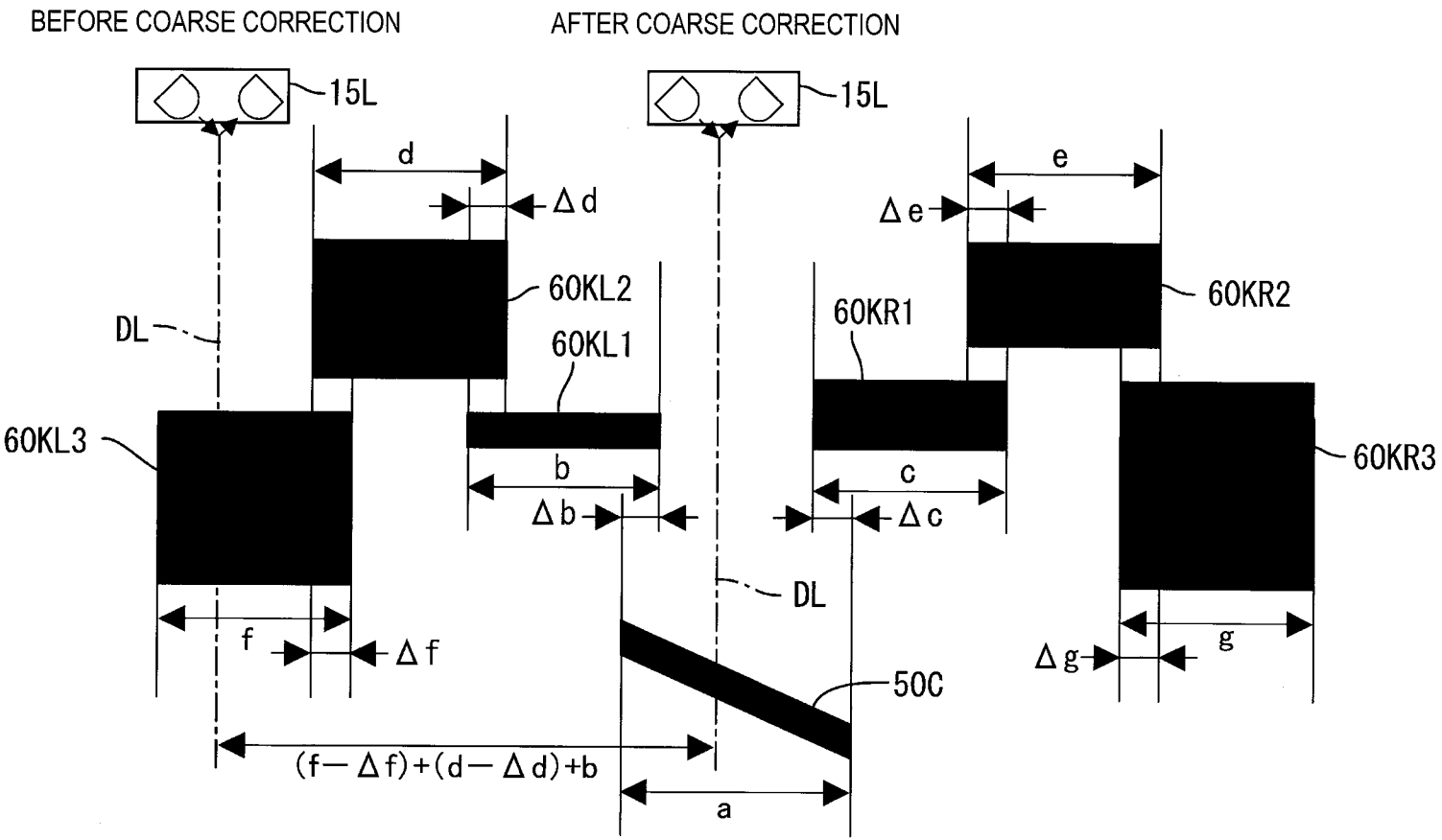
FIG. 13 is a view illustrating misalignment correction to the mark group shown in FIG. 12.

In this case, it is preferable to form the individual marks at positions where the condition for the main scanning direction length, $\{(b+\Delta b)<a\}$, $\{(d+\Delta d)<a\}$, $\{(f+\Delta f)<a\}$, $\{(c+\Delta c)<a\}$, $\{(e+\Delta e)<a\}$, or $\{(g+\Delta g)<a\}$ is satisfied. The lengths b, d, and f and the lengths c, e, and g may have any magnitude correlation. In this case, for example, it is assumed that the patch formation position is significantly misaligned to the right side in the main scanning direction X, as shown in FIG. 13, and thus a mark 60KL3 is detected. In this case, a coarse correction amount becomes $(f-\Delta f)+(d-\Delta d)+b$, and correction is performed such that the patch formation position is shifted to the left side in the main scanning direction X by the coarse correction amount.

(5) In each of the above-mentioned exemplary embodiments, an example in which the mark group 60 is configured of the left mark group 60L (the second mark or the first mark) and the right mark group 60R (the second mark or the first mark) has been described. However, the present invention is not limited thereto. For example, the mark group 60 may be configured of only the left mark group 60L or only the right mark group 60R. Even in this case, it is possible to perform the coarse correction on the patch groups 50 by detecting the mark groups 60, and it is possible to further reduce the amount of toners (developers) that is used for image adjustment, as compared to each of the above-mentioned exemplary embodiments.

For example, in a case where after the formation of the left mark group 60L, the formation of the patch groups 50 starts from before the detection timing of the left mark group 60L, and the left mark group 60L is not detected, if the patch groups 50 are detected, the CPU 40 may continue the formation of the patch groups 50. Meanwhile, in a case where the left mark group 60L is not detected, if any patch group 50 is not detected, the CPU 40 may cancel the formation of the patch groups 50, and perform correction such that the patch formation position is shifted to the left side.

(6) In each of the above-mentioned exemplary embodiments, an example in which the mark groups 60 are formed on both edge portions of the belt 13 in the main scanning direction X has been described. However, the present invention is not limited thereto. The mark group 60 may be formed on one of the left and right edge portions. Even in this case, it is possible to appropriately perform the coarse correction on the patch groups 50. This is because, in general, in a case where the patch formation position on the belt 13 is significantly misaligned, it is considered that the same degree of misalignment is detected in the left and right edge portions of the belt 13.

(7) In each of the above-mentioned exemplary embodiments, an example in which the mark groups 60 (second adjustment image) is formed, and then the patch groups 50 (first adjustment image) is formed has been described. However, the present invention is not limited thereto. Reversely, the patch groups 50 may be first formed, and after determination based on detection of the patch groups 50, the mark groups 60 may be formed. In this case, in a case where an expected number of patch groups 50 are detected (a case where the patch groups 50 is not significantly misaligned), since it is not required to form the mark groups 60, it is possible to reduce the amount of developers that is used for image adjustment.

(8) In each of the above-mentioned exemplary embodiments, an example in which the present invention is applied to the direct tandem type color printer has been described. However, the present invention can also be applied to an intermediate transfer type color printer. In this case, an image to be formed a sheet 3 is formed on an intermediate transfer belt (an example of the carrier).

What is claimed is:

1. An image forming apparatus comprising:

an image forming unit that forms an image using a developer;

a carrier that carries and conveys the image formed by the image forming unit;

a detecting unit that detects a first adjustment image based on a light reception result of reflection of light projected toward the carrier when the first adjustment image is formed on the carrier by the image forming unit, a length of the first adjustment image in an orthogonal direction, which is a direction orthogonal to a conveyance direction of the image, being a first orthogonal direction length; and an adjusting unit that adjusts a formation condition of an image to be formed on a sheet based on a result of the detection of the first adjustment image by the detecting unit, wherein the image forming unit forms a second adjustment image having a first mark on the carrier, a length of the first mark in the orthogonal direction being a second orthogonal direction length, wherein when the detecting unit detects the second adjustment image based on a light reception result of reflection of light projected toward the carrier, the adjusting unit adjusts a position of the first adjustment image to be formed on the carrier in the orthogonal direction by using the second orthogonal direction length, wherein the second orthogonal direction length of the first mark is smaller than the first orthogonal direction length of the first adjustment image, wherein the first mark is formed at a position on the carrier that is different from a position of the first adjustment image in the conveyance direction, and wherein a first length, which is a length between an intersection of the first mark and a virtual first straight line that extends in the conveyance direction from a first end portion of the first adjustment image in the orthogonal direction and a first end portion of the first mark, which is closer to a virtual second straight line that extends in the conveyance direction from a second end portion of the first adjustment image in the orthogonal direction than a second end portion of the first mark, is smaller than a length obtained by subtracting the second orthogonal direction length from the first orthogonal direction length.

2. The image forming apparatus according to claim 1, wherein the first mark is formed in a quadrangular shape.

3. The image forming apparatus according to claim 2, wherein the quadrangular shape includes a rectangular shape.

4. The image forming apparatus according to claim 3, wherein the second adjustment image includes a plurality of marks including the first mark, and wherein each of the plurality of marks are formed in a rectangular shape such that lengths of the plurality of marks in the orthogonal direction are smaller than the first orthogonal direction length and lengths of the plurality of marks in the conveyance direction are different from each other, and wherein each of the plurality of marks are formed at different positions on the carrier on the same side relative to a virtual center line between the first straight line and the second straight line, such that when one of the marks is extended in the conveyance direction, the extended mark overlaps another mark.

5. The image forming apparatus according to claim 1, wherein the second adjustment image further includes a second mark that is formed at a position on the opposite side of the first mark relative to a virtual center line between the first straight line and the second straight line, such that a length of the second mark in the orthogonal direction is a third orthogonal direction length that is smaller than the first orthogonal direction length, and wherein the image forming unit forms the second mark such that a second length, which is a length between an intersection of the second mark and the second straight line and a first end portion of the second mark, which is closer to the first straight line than a second end portion of the second mark, is smaller than a length obtained by subtracting the third orthogonal direction length from the first orthogonal direction length.

6. The image forming apparatus according to claim 5, wherein the image forming unit starts formation of the first adjustment image when a detecting timing of the second adjustment image has passed after formation of the second adjustment image.

7. The image forming apparatus according to claim 5, wherein the image forming unit starts formation of the first adjustment image from before a detection timing of the second adjustment image after formation of the second adjustment image, and if the second adjustment image is detected, the image forming unit stops the formation of the first adjustment image and restarts the formation of the first adjustment image from the beginning after adjustment of the position of the first adjustment image in the orthogonal direction by the adjusting unit.

8. The image forming apparatus according to claim 5, wherein the first mark has a first conveyance direction length in the conveyance direction, and wherein the second mark has a second conveyance direction length different from the first conveyance direction length in the conveyance direction.

9. The image forming apparatus according to claim 8, wherein the first mark and the second mark are connected to each other by a connection portion having a third conveyance direction length different from the first conveyance direction length and the second conveyance direction length in the conveyance direction.

10. The image forming apparatus according to claim 8, wherein the first mark is configured of a first mark group that includes a plurality of marks and the second mark is configured of a second mark group that includes a plurality of marks, and wherein each of the plurality of marks of each of the first and second mark groups are formed in a rectangular shape such that lengths of the plurality of marks in the orthogonal direction are smaller than the first orthogonal direction length and lengths of the plurality of marks in the conveyance direction are different from each other, and wherein each of the plurality of marks are formed at different positions in the orthogonal direction on the carrier on the same side relative to the virtual center line between the first straight line and the second straight line, such that when one of the plurality of marks is extended in the conveyance direction, the extended mark overlaps another mark.

11. The image forming apparatus according to claim 5, wherein the first mark and the second mark have the same length in the conveyance direction.

12. The image forming apparatus according to claim 11, wherein the first mark and the second mark are formed at different positions in the conveyance direction.

13. The image forming apparatus according to claim 11, wherein a number of marks configuring the first mark and a number of marks configuring the second mark are different.

14. The image forming apparatus according to claim 5, wherein the first mark is formed on a left side relative to the second mark in the orthogonal direction when viewed toward the downstream side in the conveyance direction, and wherein when the detecting unit detects the first mark, the adjusting unit determines that a formation position of the first adjustment image has been misaligned to a right side in the orthogonal direction, and adjusts the position of the first adjustment image to the left side in the orthogonal direction.

15. The image forming apparatus according to claim 1, wherein, when formation of the first adjustment Image starts from before a detection timing of the second adjustment image after formation of the second adjustment image and the second adjustment image is not detected, if the first adjustment image is detected, the image forming unit continues the formation of the first adjustment image, and if the first adjustment image is not detected, the image forming unit stops the formation of the first adjustment image.

16. A method of adjusting an image formed by an image forming unit using a developer by forming a first adjustment image and a second adjustment image for adjusting the Image on a carries that carries and conveys the image, the method comprising:

causing the image forming unit to form the first adjustment image on the carrier such that a length of the first adjustment image in an orthogonal direction, which is a direction orthogonal to a conveyance direction of the image, is a first orthogonal direction length;

detecting the first adjustment image based on a light reception result of reflection of light projected toward the carrier when the first adjustment image is formed;

adjusting a formation condition of the image to be formed on a sheet based on a result of the detection of the first adjustment image;

causing the image forming unit to form the second adjustment image having a first mark on the carrier such that a length of the first mark in the orthogonal direction is a second orthogonal direction length; and detecting the second adjustment Image based on a light reception result of reflection of light projected toward the carrier, wherein, the image forming unit is caused to form the second adjustment image having the first mark such that, the second orthogonal direction length of the first mark is smaller than the first orthogonal direction length of the first adjustment image, the first mark is formed at a position on the carrier that is different from a position of the first adjustment image in the conveyance direction, and a first length, which is a length between an intersection of the first mark and a virtual first straight line that extends in the conveyance direction from a first end portion of the first adjustment image in the orthogonal direction and a first end portion of the first mark, which is closer to a virtual second straight line that extends in the conveyance direction from a second end portion of the first adjustment image in the orthogonal direction than a second end portion of the first mark, is smaller than a length obtained by subtracting the second orthogonal direction length from the first orthogonal direction length, and wherein, the formation condition of the image is adjusted such that, if the second adjustment image is detected, a position of the first adjustment image to be formed on the carrier in the orthogonal direction is adjusted by using the second orthogonal direction length.

* * * * *